US007159576B2

(12) United States Patent
Yamashita et al.

(10) Patent No.: US 7,159,576 B2
(45) Date of Patent: Jan. 9, 2007

(54) FUEL FEED APPARATUS

(75) Inventors: Keiichi Yamashita, Kariya (JP); Kouji Izutani, Nagoya (JP); Noriya Matsumoto, Okazaki (JP); Koji Miwa, Toyota (JP)

(73) Assignees: Denso Corporation, Kariya (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/447,911

(22) Filed: Jun. 7, 2006

(65) Prior Publication Data

US 2006/0272619 A1 Dec. 7, 2006

(30) Foreign Application Priority Data

Jun. 7, 2005 (JP) ..... 2005-166642

(51) Int. Cl.
*F02M 37/04* (2006.01)

(52) U.S. Cl. ..... 123/509; 123/519

(58) Field of Classification Search ..... 123/509, 123/514, 516, 518, 519, 520, 521
See application file for complete search history.

(56) References Cited

U.S. PATENT DOCUMENTS 4,919,103 A * 4/1990 Ishiguro et al. ..... 123/514
5,762,049 A * 6/1998 Jones et al. ..... 123/514
6,302,144 B1 * 10/2001 Graham et al. ..... 137/565.17
6,401,751 B1 * 6/2002 Murakoshi et al. .... 137/565.34
2001/0029931 A1 * 10/2001 Burke et al. ..... 123/520
2001/0029932 A1 * 10/2001 Ozaki et al. ..... 123/520
2003/0111060 A1 * 6/2003 Ito et al. ..... 123/509
2004/0244780 A1 * 12/2004 Kempka et al. ..... 123/509
2005/0133096 A1 * 6/2005 Brunel et al. ..... 137/565.17
2005/0155584 A1 * 7/2005 Okazono et al. ..... 123/509

FOREIGN PATENT DOCUMENTS

JP 2004-251165 9/2004

* cited by examiner

*Primary Examiner*—Carl S. Miller
(74) *Attorney, Agent, or Firm*—Nixon & Vanderhye P.C.

(57) ABSTRACT

A fuel feed apparatus includes a lid module that includes a canister accommodated in a fuel tank. The canister defines a space in the vicinity of a lateral periphery of the canister in the fuel tank. The fuel feed apparatus further includes a pump module that is located in the space. The fuel feed apparatus further includes a connecting member that is axially slidable with respect to the lid module and the pump module along the lateral periphery of the canister and a lateral periphery of the pump module. When the lid module is connected to the fuel tank by moving the lid module toward the pump module along the connecting member, the connecting member hooks to the pump module, so that the connecting member is restricted from moving in a direction, in which the lid module moves toward the pump module.

9 Claims, 9 Drawing Sheets

FUEL FEED APPARATUS

CROSS REFERENCE TO RELATED APPLICATIONS

This application is based on and incorporates herein by reference Japanese Patent Application No. 2005-166642 filed on Jun. 7, 2005.

FIELD OF THE INVENTION

The present invention relates to a fuel feed apparatus that is assembled to a fuel tank.

BACKGROUND OF THE INVENTION

According to JP-A-2004-251165, a fuel feed apparatus includes a canister and a fuel pump, which are accommodated in a fuel tank. The canister absorbs fuel vapor in the fuel tank. The fuel feed apparatus has a flange that covers an opening of the fuel tank, and supports the canister. The canister defines a remaining space in the vicinity of the lateral periphery thereof in the fuel tank. A pump module including the fuel pump is located in the remaining space. In this structure, the pump module and the canister can be accommodated in the fuel tank by utilizing the remaining space, even when the fuel tank is low.

The flange connects with a shaft, which is assembled to the lateral periphery of the pump module, so that the flange is axially slidable relative to the pump module via the shaft.

However, in this structure, when the flange and the canister are moved toward the pump module for an insertion length, the shaft moves toward the bottom of the fuel tank for the same insertion length. For example, the pump module is assembled to the shaft connected to the flange. Subsequently, the fuel feed apparatus is assembled to the fuel tank by moving the flange and the canister toward the pump module. In this condition, the shaft may be urged onto the inner bottom surface of the fuel tank before covering the opening of the fuel tank using the flange. As a result, the fuel tank may not be assembled to the fuel tank.

In the structure disclosed in JP-A-2004-251165, the opening, through which the canister and the pump module are inserted into the fuel tank, is much greater than the cross sectional area of each of the canister and the pump module. The canister and the pump module can be inserted into the fuel tank through the opening in a condition, in which the flange and the canister are set in the vicinity of the pump module, because of the large opening of the fuel tank. In this structure, the insertion length of the canister can be reduced, so that the shaft can be restricted from being urged onto the inner bottom surface of the fuel tank. However, when the opening of the fuel tank is enlarged, mechanical strength of the fuel tank may be impaired.

Furthermore, the fuel feed apparatus may not be installed to the fuel tank in a structure, in which a space outside of the opening of the fuel tank is small, and the fuel feed apparatus occupies a radially large space by setting the canister in the vicinity of the pump module. In this case, the canister needs to be separated from the pump module in order to assemble the pump module and canister into the fuel tank in this order through the small space. However, the insertion length becomes large, and the shaft may be urged onto the inner bottom surface of the fuel tank before the flange covers the opening of the fuel tank.

SUMMARY OF THE INVENTION

In view of the foregoing and other problems, it is an object of the present invention to produce a fuel feed apparatus that is assembled to a fuel tank through a downsized opening.

According to one aspect of the present invention, a fuel feed apparatus pumps fuel in a fuel tank having an opening. The fuel feed apparatus includes a lid module that includes a canister accommodated in the fuel tank, the canister defining a space in the vicinity of a lateral periphery of the canister in the fuel tank, the canister detachably absorbing fuel vapor in the fuel tank, the lid module covering the opening of the fuel tank. The fuel feed apparatus further includes a pump module that is located in the space for pumping fuel in the fuel tank. The fuel feed apparatus further includes a connecting member that connects the lid module with the pump module, the connecting member axially slidable with respect to the lid module and the pump module along the lateral periphery of the canister and a lateral periphery of the pump module. When the lid module is connected to the fuel tank by moving the lid module toward the pump module along the connecting member, the connecting member hooks to the pump module, so that the connecting member is restricted from moving in a direction, in which the lid module moves toward the pump module.

In this construction, the pump module and the canister can be inserted into the fuel tank through the opening in this order, even when the opening is small.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
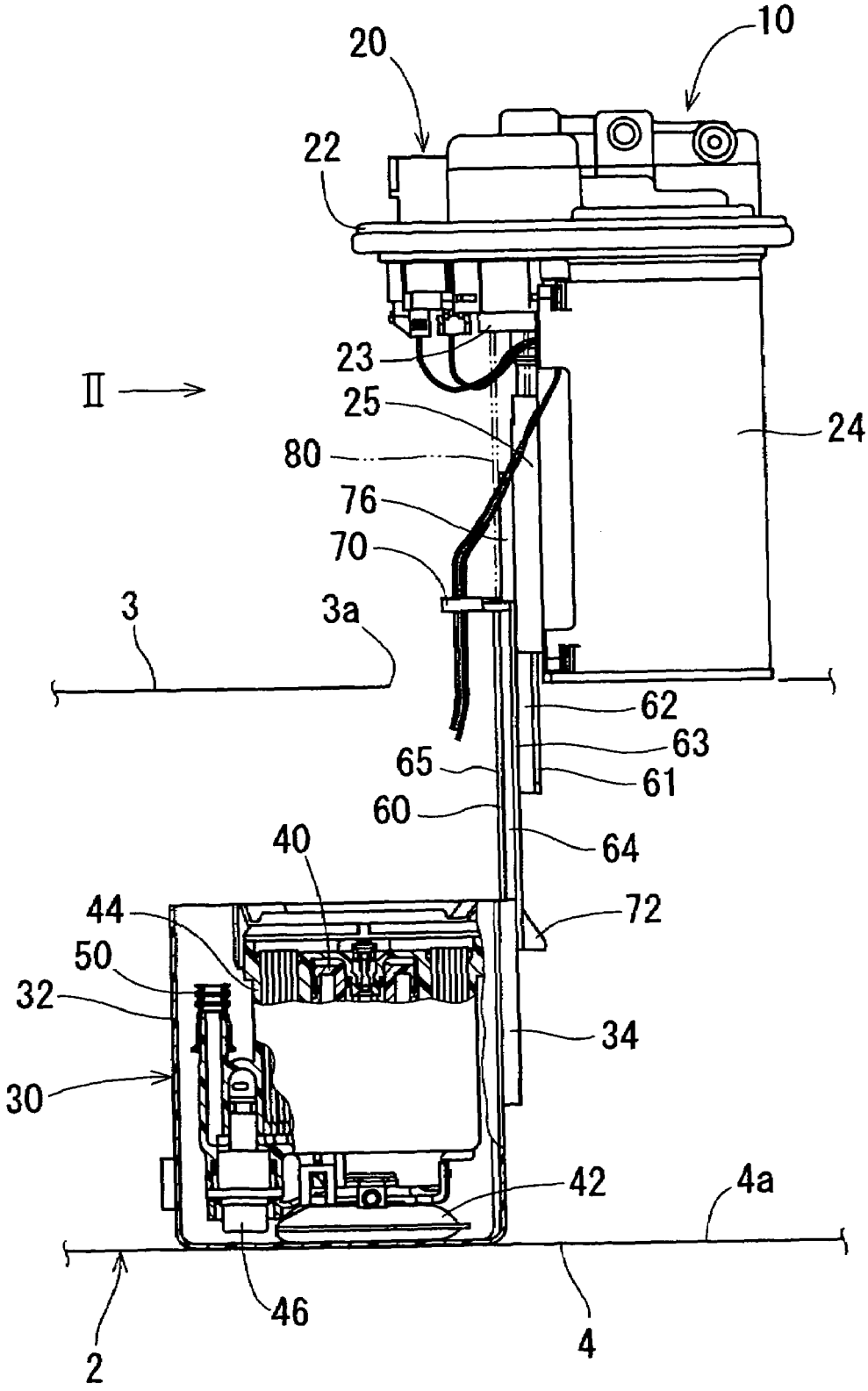
FIG. 1 is a longitudinal partially sectional view showing a fuel feed apparatus, according to a first embodiment.
Figure 2:
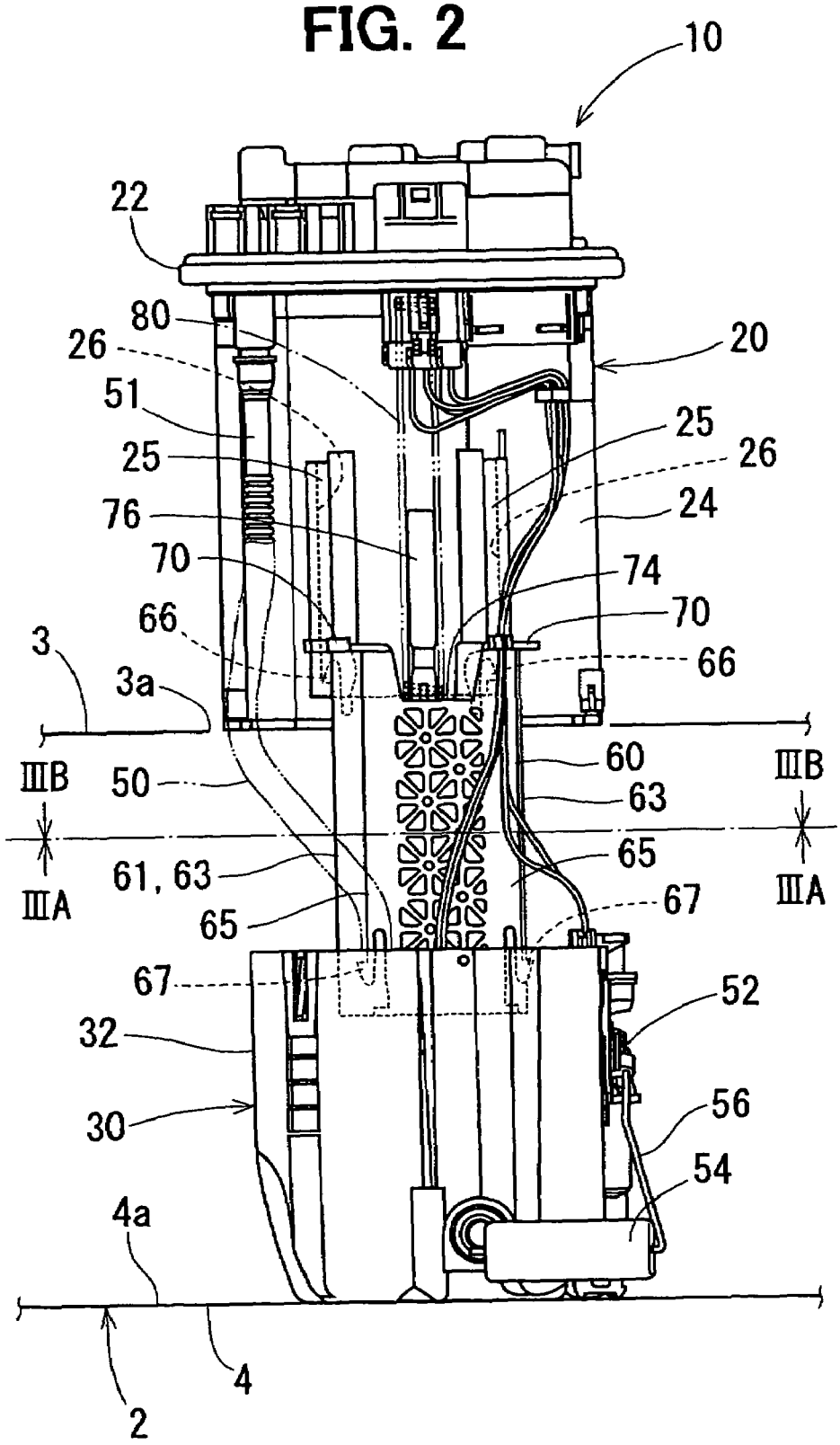
FIG. 2 is a side view when being viewed from the arrow II in FIG. 1.
Figure 4:
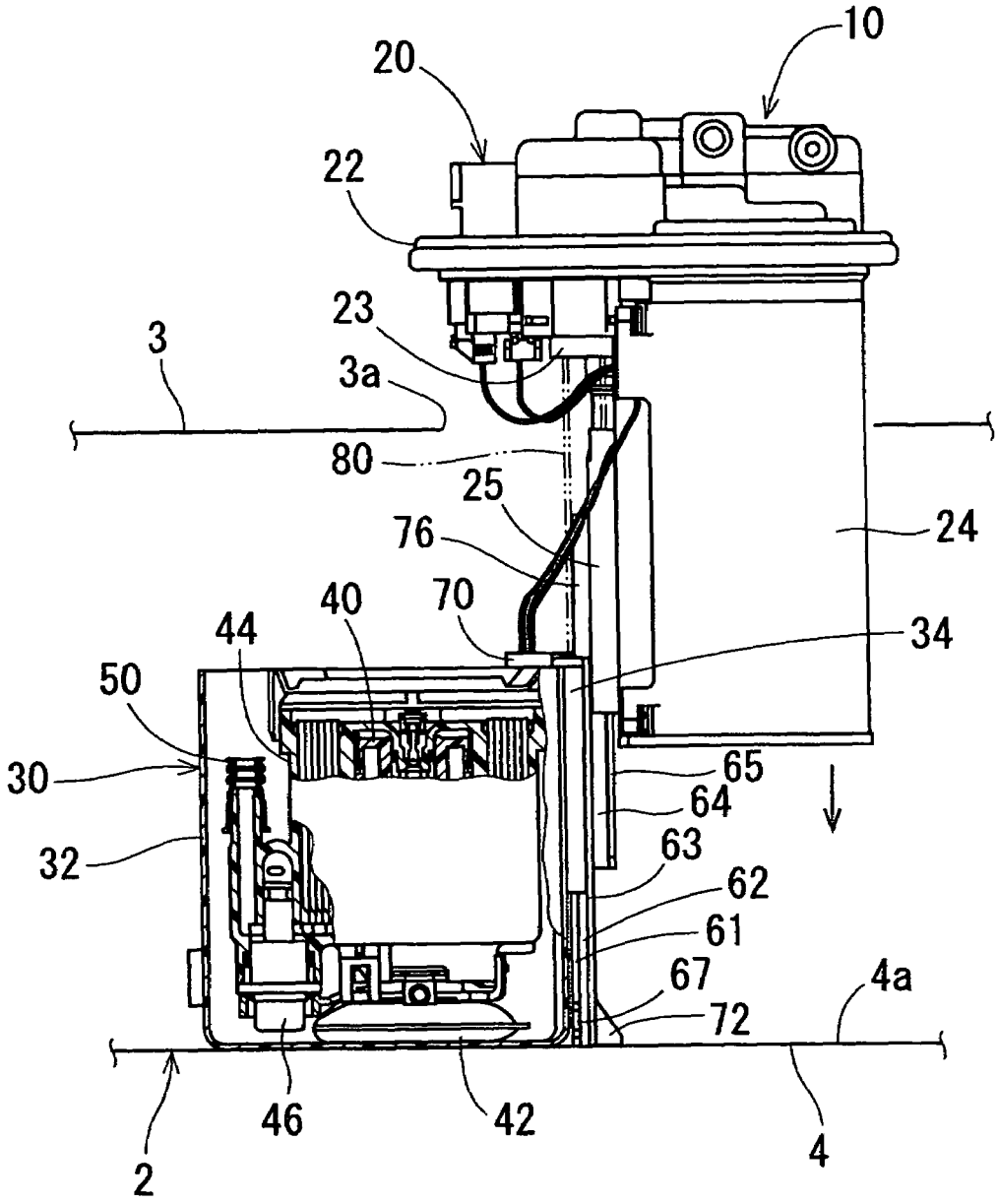
FIG. 4 is a longitudinal partially sectional view showing the fuel feed apparatus, which is partially inserted into a fuel tank, according to the first embodiment.
Figure 5:
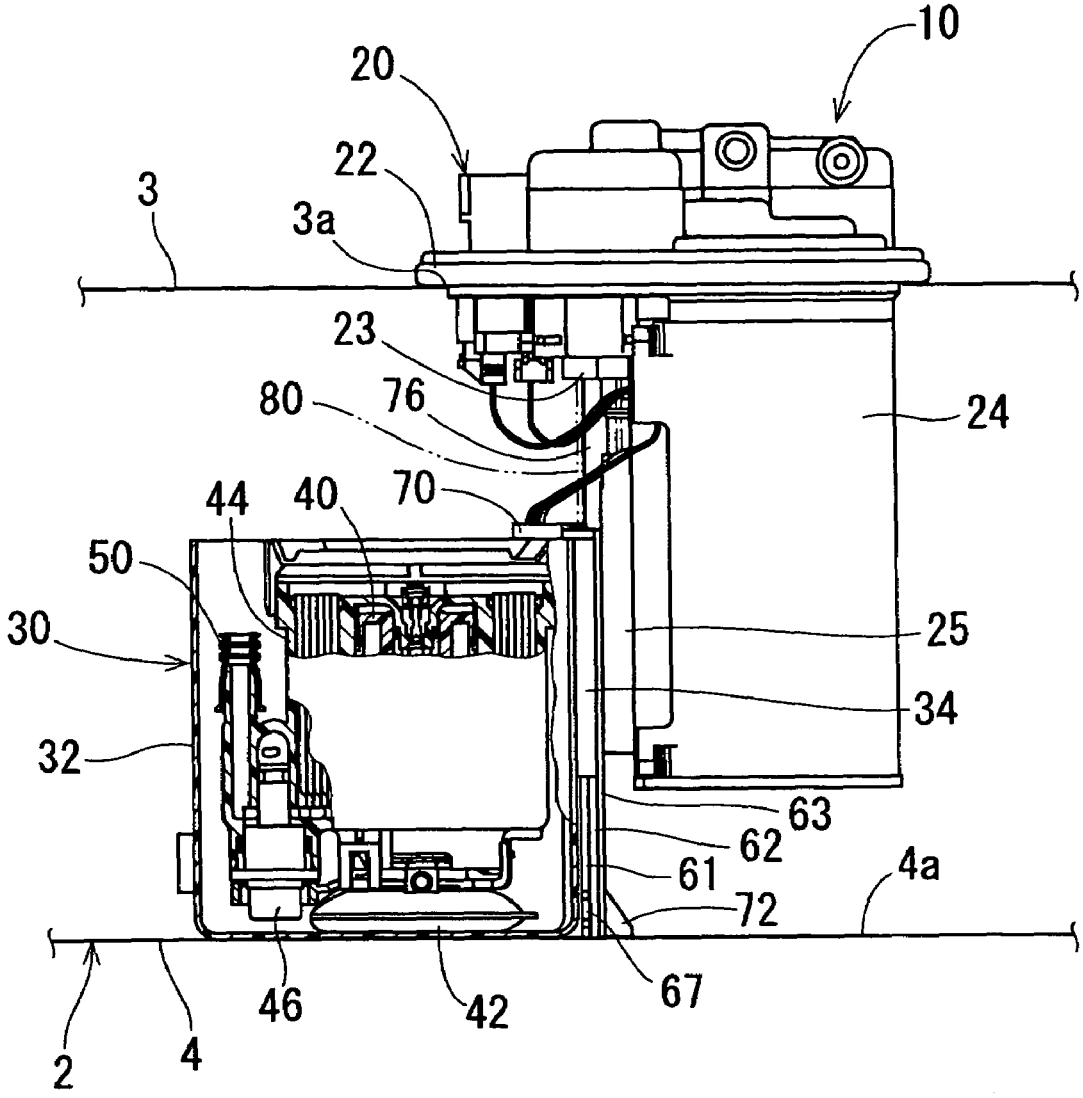
FIG. 5 is a longitudinal partially sectional view showing the fuel feed apparatus, which is assembled to the fuel tank, according to the first embodiment.

FIGS. 1, 2, and 4 depict a fuel feed apparatus 10, which is being assembled to a fuel tank 2 of a vehicle, for example. FIG. 5 depicts the fuel feed apparatus 10, which is already assembled to the fuel tank 2.

As referred to FIGS. 1, 2, the lid module 20 of the fuel feed apparatus 10 includes a flange 22 and a canister 24. The flange 22 and the canister 24 may be integrally coupled. The flange 22 serves as a lid member that covers an opening 3*a* formed in an upper wall 3 of the fuel tank 2. The canister 24 detachably absorbs fuel vapor generated in the fuel tank 2. The flange 22 connects with a vapor outlet pipe, a vent pipe, a fuel discharge pipe, an electric connector, and the like. The vapor outlet pipe introduces fuel vapor, which is absorbed using the canister 24, to the outside of the fuel tank 2. The flange 22 has a cylindrical portion 23 on the side of the pump module 30. The cylindrical portion 23 has an inner bottom portion, to which a spring 80 hooks. The canister 24 has the lateral periphery, to which two guide portions 25 are provided for guiding a connecting member 60. The guide portions 25 are distant from each other with respect to the circumferential direction of the canister 24. The guide portions 25 extend substantially in the axial direction of the canister 24.

The pump module 30 is constructed of a sub-tank 32 receiving a fuel pump 40. The sub-tank 32 has the exterior lateral periphery, to which two guide portions 34 are provided for guiding the connecting member 60. The guide portions 34 are distant from each other with respect to the circumferential direction of the sub-tank 32. The guide portions 34 extend substantially in the axial direction of the sub-tank 32. Fuel in the fuel tank 2 is drawn into the sub-tank 32 using a jet pump, or the like.

The fuel pump 40 pumps fuel, in the sub-tank 32, after passing through a suction filter 42 removing foreign matter contained in the fuel. The fuel filter 44 is in a substantially cylindrical shape. The fuel filter 44 surrounds the outer circumferential periphery of the fuel pump 40 for further removing small foreign matters from the fuel discharged from the fuel pump 40. A pressure regulator 46 controls pressure of fuel discharged from the fuel pump 40. The fuel, which is controlled in pressure through the pressure regulator 46 is supplied to the outside of the fuel tank 2 after passing through a bellows pipe 50 and the flange 22. The bellows pipe 50 has a substantially straight pipe portion 51 (FIG. 2) connecting with the flange 22.

A sender gauge 52 is provided to a lateral periphery of the sub-tank 32 in a position, which is circumferentially distant from the guide portions 34. The sender gauge 52 connects with a float 52 via an arm 56.

Figure 3A:
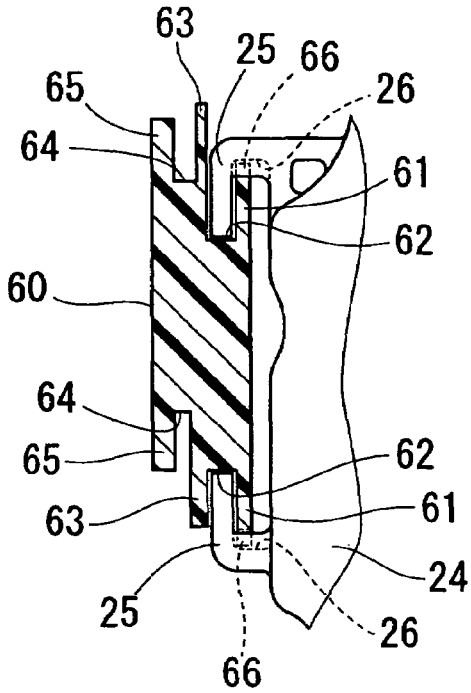
FIG. 3A is a longitudinal sectional view taken along the line IIIA—IIIA in FIG. 2.
Figure 3B:
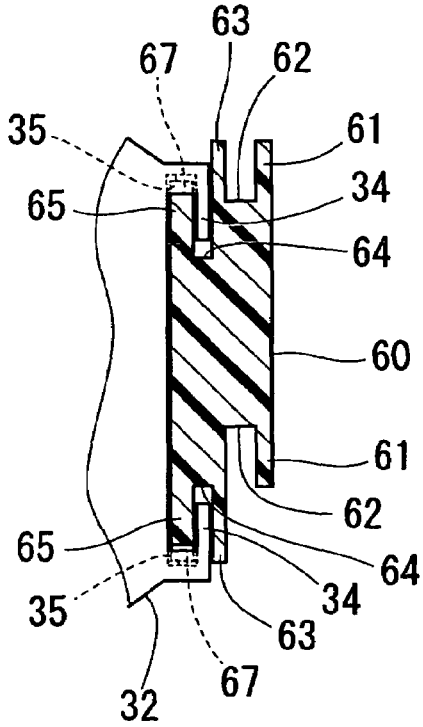
FIG. 3B is a longitudinal sectional view taken along the line IIIB—IIIB in FIG. 2.

The connecting member 60 is formed of resin to be in a substantially plate shape. The connecting member 60 partially has a mesh structure (FIG. 2) in order to reduce weight while securing mechanical strength thereof. Protrusions 61, 63, 65 are provided on both ends with respect to the width direction of the connecting member 60. As shown in FIGS. 3A, 3B, the protrusions 61, 63, 65 are arranged from the side of the canister 24 in this order with respect to the thickness direction of the connecting member 60. Each of the protrusions 61, 63, 65 are in a substantially plate-shape. Each of the protrusions 61, 63, 65 extends in a substantially axial direction of the connecting member 60. The protrusions 61, 63 have a groove 62 therebetween. The protrusions 63, 65 have a groove 64 therebetween. Each of the grooves 62, 64 extends substantially in the axial direction of the connecting member 60.

FIGS. 3A, 3B depict a condition, in which the lid module 20, the pump module 30, and the connecting member 60 are engaged with each other. As referred to FIG. 3A, the protrusion 61 of the connecting member 60 engages with a groove 26 of the guide portion 25 provided to the canister 24. In addition, the guide portion 25 engages with the groove 62, so that the connecting member 60 is assembled to the canister 24 such that the connecting member 60 is axially movable with respect to the canister 24. As referred to FIG. 3B, the protrusion 65 of the connecting member 60 engages with a groove 35 of the guide portion 34 provided to the sub-tank 32. In addition, the guide portion 34 engages with the groove 64 of the connecting member 60, so that the connecting member 60 is assembled to the sub-tank 32 such that the connecting member 60 is axially movable with respect to the sub-tank 32.

As referred to FIGS. 2, 3A, and 3B, the protrusion 61 has an axially upper portion on the side of the lid module 20. The axially upper portion of the protrusion 61 has a claw 66. The protrusion 65 has an axially lower portion on the side of the pump module 30. The axially lower portion of the protrusion 65 has a claw 67. The claws 66, 67 are elastically deformable in a substantially width direction of the connecting member 60. The claw 66 hooks to a lower portion of the groove 26 of the guide portion 25 of the canister 24, so that the connecting member 60 is restricted from dropping off the canister 24. The claw 67 hooks to an upper portion of the groove 35 of the guide portion 34 of the sub-tank 32, so that the connecting member 60 is restricted from dropping off the sub-tank 32. FIGS. 1, 2 depict conditions, in which the claws 66, 67 of the connecting member 60 respectively hook to the grooves 26, 35, so that the connecting member 60 is restricted from dropping off both the lid module 20 and the pump module 30. In these conditions depicted by FIGS. 1, 2, the lid module 20 is most distant from the pump module 30 in a condition, in which the lid module 20 connects with the pump module 30 via the connecting member 60. The claws 66, 67 and the grooves 26, 35 construct a drop off restricting structure.

The connecting member 60 is detachable from the canister 24 by elastically deforming the two claws 66 such that the distance between the two claws 66 becomes small. The connecting member 60 becomes detachable from the sub-tank 32 by elastically deforming the two claws 67 such that the distance between the two claws 67 becomes small. As referred to FIGS. 1, 2, the connecting member 60 has an upper portion on the side of the lid module 20. The upper portion of the connecting member 60 has a hooking portion 70 that protrudes to the radially inner side of the sub-tank 32. As referred to FIGS. 1, 4, the connecting member 60 moves to the side of an inner bottom surface 4*a* of a bottom wall 4 of the fuel tank 2 along the guide portion 34 of the sub-tank 32, so that the hooking portion 70 hooks to the upper end of the periphery of the sub-tank 32 (FIG. 4). Thus, the connecting member 60 is restricted from further moving toward the inner bottom surface 4*a* of the fuel tank 2.

As referred to FIG. 4, the connecting member 60 has at least one tilt restricting portion 72 on the side of the inner bottom surface 4*a* of the fuel tank 2. The tilt restricting portion 72 constructs a tilt restricting member. The tilt restricting portion 72 extends to a substantially opposite side of the sub-tank 32 along the inner bottom surface 4*a* of the fuel tank 2.

As referred to FIG. 2, the connecting member 60 has an axially upper portion on the side of the lid module 20. The axially upper portion of the connecting member 60 has an upper center portion, which is in a substantially center with respect to the width direction of the connecting member 60. This upper center portion of the connecting member 60 is recessed, thereby defining a spring seat 74. A spring guide 76 is in a substantially cylindrical shape. The spring guide 76 extends upwardly from the bottom of the spring seat 74. The spring guide 76 has the outer circumferential periphery surrounded by the spring 80. The upper end of the spring guide is distant from the cylindrical portion 23 for a predetermined distance in a condition, in which the fuel feed apparatus 10 is intermediately assembled to the fuel tank 2.

In the conditions shown by FIGS. 1, 2, one end of the spring 80 is inserted into the cylindrical portion 23 of the flange 22. The other end of the spring 80 hooks to the spring seat 74 by being guided along the spring guide 76 of the connecting member 60. In this condition, the one end of the spring 80 may hook to the bottom of the cylindrical portion 23. The spring 80 is released from biasing force in a condition, in which the one end of the spring 80 is inserted into the cylindrical portion 23, and the other end of the spring 80 does not hook to the bottom of the cylindrical portion 23, so that the spring 80 is released from biasing force.

Next, an assembling process of the fuel feed apparatus 10 to the fuel tank 2 is described.

In an initial step, FIGS. 1, 2 depict conditions, in which the claws 66, 67 of the connecting member 60 respectively hook to the groove 26 of the canister 24 and the groove 35 of the sub-tank 32, so that the connecting member 60 is restricted from dropping off both the canister 24 and the sub-tank 32. In these conditions depicted by FIGS. 1, 2, the lid module 20 is axially most distant from the pump module 30. FIGS. 1, 2 also depict conditions, in which the pump module 30 is inserted into the fuel tank 2 through the opening 3*a* of the fuel tank 2, so that the bottom of the sub-tank 32 makes contact with the inner bottom surface 4*a* of the fuel tank 2. The pump module 30 is inserted into the fuel tank 2 through the opening 3*a*, and subsequently, the canister 24 is inserted into the fuel tank 2 through the opening 3*a*. Therefore, the pump module 30 and the canister 24 are located in an offset manner laterally with respect to each other. That is, the pump module 30 and the canister 24 are laterally displaced from each other. In the conditions depicted by FIGS. 1, 2, the hooking portion 70 of the connecting member 60 does not hook to the upper end of the periphery of the sub-tank 32. Therefore, the sub-tank 32 is not applied with force toward the bottom wall 4 of the fuel tank 2.

In an intermediate step, the lid module 20 is inserted into the fuel tank 2 from the conditions depicted by FIGS. 1, 2, so that the connecting member 60 moves toward the inner bottom surface 4*a* of the fuel tank 2 together with the lid module 20, while the connecting member 60 is guided by the guide portion 34 of the sub-tank 32. Thus, as referred to FIG. 4, the hooking portion 70 of the connecting member 60 hooks to the upper end of the periphery of the sub-tank 32.

The bellows pipe 50 connects with the flange 22 via the substantially straight pipe portion 51. Therefore, when the canister 24 is inserted into the fuel tank 2 to the position depicted by FIG. 4, the bellows pipe 50 can be restricted from being largely unfolded to the outside of the opening 3*a*. That is, the bellows pipe 50 can be restricted from being largely cluttered to the outside of the opening 3*a*. Thus, the bellows pipe 50 can be restricted from causing interference relative to the opening 3*a* of the fuel tank 2, so that the canister 24 can be readily inserted into the fuel tank 2.

The lid module 20 is further pressed toward the inner bottom surface 4*a* of the fuel tank 2 from the condition depicted by FIG. 4 against bias force of the spring 80. In this condition, the lid module 20 moves toward the inner bottom surface 4*a* of the fuel tank 2 along the connecting member 60, while the position of the connecting member 60 is substantially maintained. Thus, in the condition depicted by FIG. 4, the bias force of the spring 80 is applied to the sub-tank 32 via the hooking portion 70 of the connecting member 60, by pressing the lid module 20.

In a final step, the lid module 20 is further pressed toward the inner bottom surface 4*a* of the fuel tank 2 from the condition depicted by FIG. 4, so that the canister 24 is entirely inserted into the fuel tank 2, as shown by FIG. 5. In this condition, the flange 22 covers the opening 3*a* of the fuel tank 2, so that the assembling process of the fuel feed apparatus 10 to the fuel tank 2 is completed. In the condition depicted by FIG. 5, the substantially cylindrical spring guide 76 is inserted into the cylindrical portion 23 such that the spring guide 76 does not make contact with the bottom of the cylindrical portion 23. That is, in this condition, the bottom of the cylindrical portion 23 is not applied with force directly from the spring guide 76.

In the condition depicted by FIG. 5, the sub-tank 32 is pressed onto the inner bottom surface 4*a* of the fuel tank 2 by the bias force of the spring 80. Therefore, the position of the sub-tank 32 is adaptive corresponding to the variation in height of the fuel tank 2, even when the height of the fuel tank 2 changes due to variation in pressure or variation in temperature, for example.

In this embodiment, the connecting member 60 is assembled axially movably to the canister 24 and the sub-tank 32. In this construction, when the lid module 20 is moved to the vicinity of the pump module 30 for assembling the fuel feed apparatus 10 to the fuel tank 2, both the lid module 20 and the pump module 30 are slid along the connecting member 60. As referred to FIG. 1, the distance, for which the connecting member 60 moves toward the inner bottom surface 4*a* of the fuel tank 2, is less than the distance, for which the lid module 20 moves toward the pump module 30. That is, the distance between the flange 22 of the lid module 20 and the upper wall 3 of the fuel tank 2 is greater than the distance between the hooking portion 70 and the upper end of the periphery of the sub-tank 32.

In the condition, in which the hooking portion 70 of the connecting member 60 hooks to the upper end of the periphery of the sub-tank 32, the connecting member 60 does not move further toward the inner bottom surface 4*a* of the fuel tank 2, even when the lid module 20 is further pressed into the fuel tank 2. Therefore, the lid module 20 can be moved toward the pump module 30 without urging the connecting member 60 against the bottom inner surface 4*a* of the fuel tank 2, even when the distance between the lid module 20 and the pump module 30 is set large in the initial assembling process of the fuel feed apparatus 10 to the fuel tank 2.

Furthermore, in the initial condition, the lid module 20 and the pump module 30 are connected via the connecting member 60 while being distant from each other. Subsequently, the pump module 30 is inserted into the fuel tank 2 through the opening 3*a* of the fuel tank 2. Furthermore, the canister 24 can be inserted into the fuel tank 2 through the opening 3*a*. In this construction, the pump module 30 and the canister 24 can be inserted into the fuel tank 2 through the opening 3*a* in this order, even when the opening 3*a* is small. Therefore, the fuel feed apparatus 10 can be assembled to the fuel tank 2 without enlarging the opening 3*a* of the fuel tank 2, even when the pump module 30 is arranged in a remaining space, which is in the vicinity of the lateral periphery of the canister 24.

Specifically, the canister 24 has the axial section, which is in a substantially semicircle including a substantially arc and a chord. The chord connects the ends of the arc. The remaining space is located adjacent to the chord of the substantially semicircle axial section of the canister 24. In the condition depicted by FIG. 5, the pump module is located in the remaining space, which is adjacent to the chord of the substantially semicircle axial section of the canister 24, in the fuel tank 2.

The opening 3*a* of the fuel tank 2 need not be enlarged, so that mechanical strength of the fuel tank 2 can be maintained.

Furthermore, even when a space (working space) on the upper side of the opening 3*a* of the fuel tank 2 is narrow, the fuel feed apparatus 10 can be taken into the fuel tank 2 through the narrow space, by connecting the lid module 20 with the pump module 30 via the connecting member 60 while being distant from each other.

In this embodiment, the lid module 20 is moved toward the pump module 30 in the condition, in which the lid module 20 connects with the pump module 30 via the connecting member 60, so that the hooking portion 70 of the connecting member 60 is hooked to the upper end of the periphery of the sub-tank 32. At this moment, the bias force of the spring 80 is applied to the upper end of the periphery of the sub-tank 32 via the hooking portion 70 of the connecting member 60, by pressing the lid module 20.

In this structure, both ends of the spring 80 need not be connected to both the flange 22 and the connecting member 60 in the initial assembling process, for example. Therefore, the length of the spring 80 between the flange 22 and the connecting member 60 can be reduced, even when the flange 22 and the connecting member 60 are distant in the initial assembling process, so that the spring 8- can be downsized.

The lid module 20 is moved toward the pump module 30, so that the distance between the cylindrical portion 23, which hooks the spring 80, and the position of the upper end of the periphery of the sub-tank 32 becomes small. Thus, the hooking portion 70 of the connecting member 60 hooks to the upper end of the periphery of the sub-tank 32. Subsequently, the force pressing the lid module 20 into the fuel tank 2 is applied to the sub-tank 32 via the spring 80 and the connecting member 60. Thus, in this structure, the length of the spring 80 between the flange 22 and the connecting member 60 can be reduced, so that the spring 80 can be downsized. Furthermore, the force pressing the lid module 20 is applied to the sub-tank 32 via the spring 80 and the connecting member 60, after the lid module 20 is moved to the vicinity of the pump module 30. Therefore, the force pressing the lid module 20 into the fuel tank 2 can be restricted from being applied to the sub-tank 32 in an oblique direction, i.e., in a inclined manner. Thus, the pump module 30 can be restricted from being inclined.

In addition, the tilt restricting portion 72 is provided to the end of the connecting member 60 on the side of the inner bottom surface 4*a* of the fuel tank 2. Therefore, even when the sub-tank 32 is applied with force such that the sub-tank 32 is inclined toward the connecting member 60, the tilt restricting portion 72 is urged onto the inner bottom surface 4*a*, so that the sub-tank 32 can be restricted from being inclined toward the connecting ember 60.

In this embodiment, the connecting member 60 is in a substantially plate-shape. Therefore, even through the connecting member 60 is a single member, the pump module 30 can be restricted form rotating with respect to the lid module 20 in a condition, in which the lid module 20 and the pump module 30 are connected with the connecting member 60. Thus, the pump module 30 can be restricted from rotating with respect to the lid module 20 when the fuel feed apparatus 10 is assembled to the fuel tank 2. Therefore, the assembling work of the fuel feed apparatus 10 to the fuel tank 2 can be facilitated.

In this embodiment, the claws 66, 67 of the connecting member 60 engage respectively with the canister 24 and the sub-tank 32, so that the connecting member 60 can be restricted from dropping off both the canister 24 and the sub-tank 32. Therefore, the condition, in which the connecting member 60 connects with the lid module 20 and the pump module 30, can be readily maintained. Thus, handling of the fuel feed apparatus 10 and assembling work of the fuel feed apparatus 10 to the fuel tank 2 can be facilitated.

Second Embodiment

Figure 6:
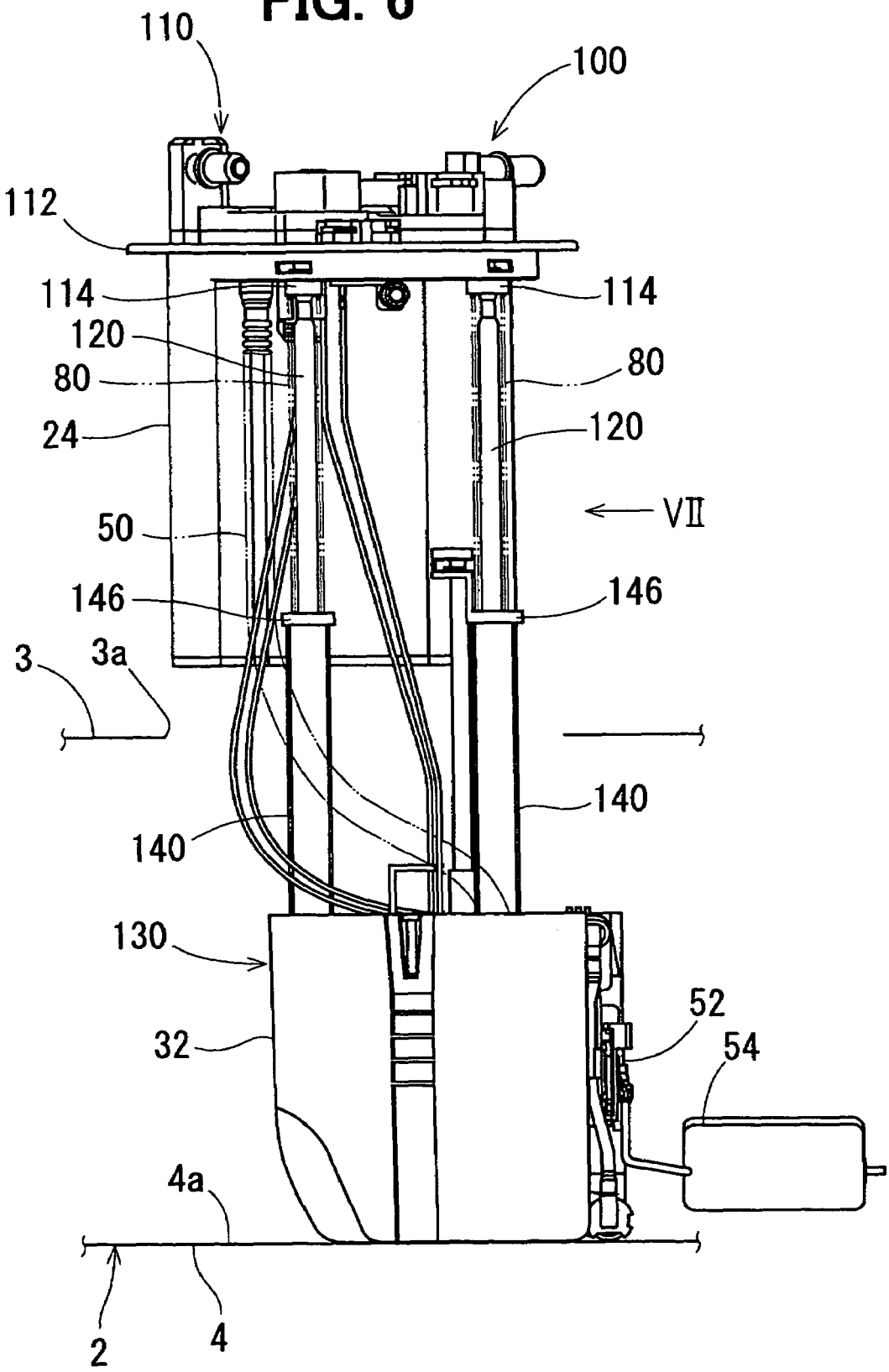
FIG. 6 is a longitudinal partially sectional view showing a fuel feed apparatus, according to a second embodiment.
Figure 7:
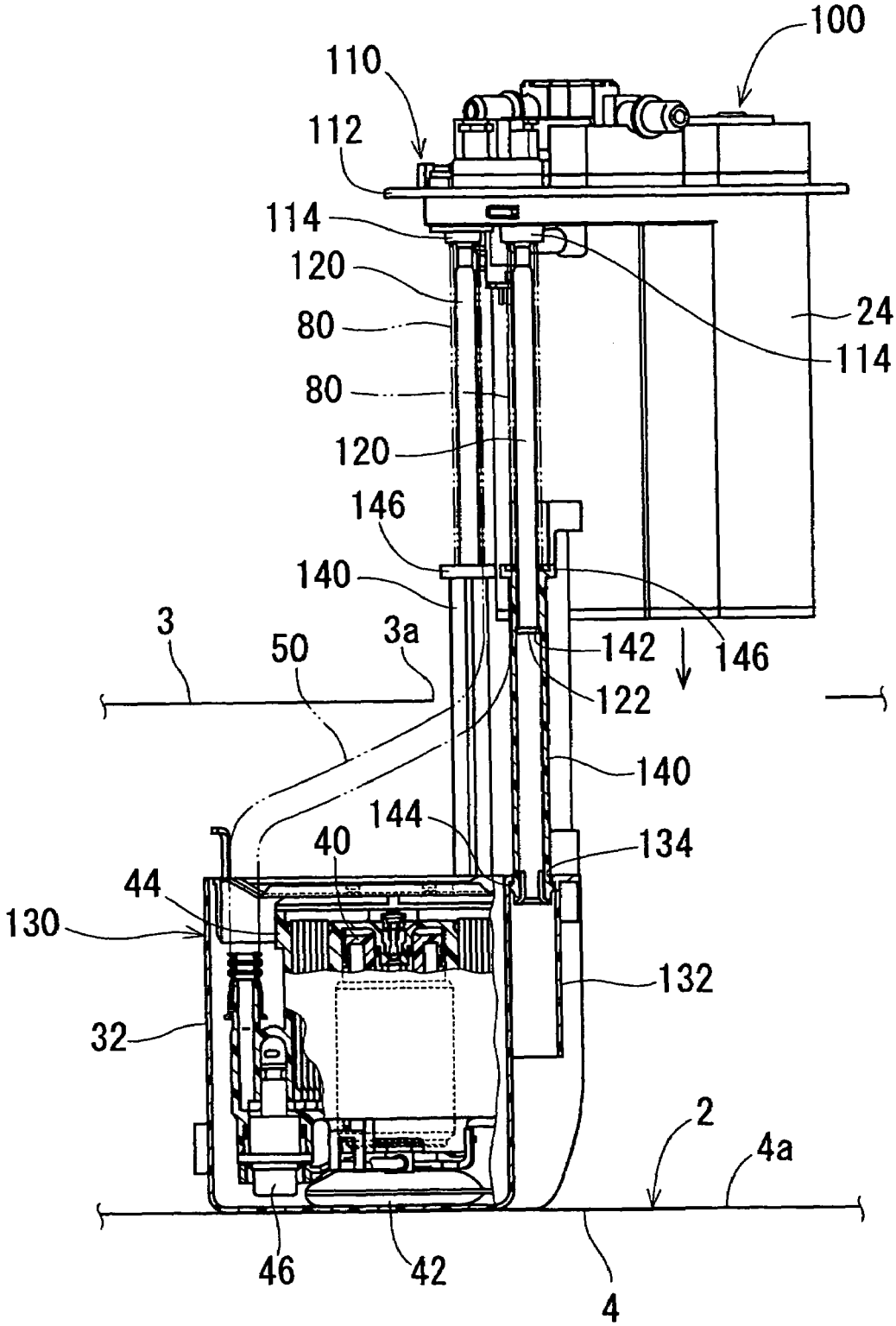
FIG. 7 is a side view when being viewed from the arrow VII in FIG. 6.

As shown in FIGS. 6, 7, a fuel feed apparatus 100 includes a lid module 110 having a flange 112 and a canister 24. The flange 112 and a canister 24 may be integrally formed. The flange 112 serves as a lid member that covers the opening 3*a* formed in the upper wall 3 of the fuel tank 2. The flange 112 includes two connecting portions 114 on the side of a pump module 130. A metallic shaft 120 is inserted into each of the connecting portions 114, thereby connecting with the connecting portions 114. The metallic shaft 120 partially constructs the lid module 110. The connecting portions 114 also serves as a spring seat of the spring 80. As referred to FIG. 7, the metallic shaft 120 has the lower end on the side of the pump module 130. The lower end of the metallic shaft 120 has a pipe flange 122.

The outer periphery on the sub-tank 32 of the pump module 130 has two guide portions 132, each being in a substantially cylindrical shape. The guide portions 132 are distant from each other with respect the circumferential direction of the sub-tank 32. The inner circumferential periphery of each of the guide portions 132 has a radially small diameter portion 134. The radially small diameter portion 134 has the inner diameter, which is smaller than the inner diameter of the other portion of the guide portions 132 excluding the radially small diameter portion 134. Each of connecting members 140 is formed of resin to be in a substantially cylindrical shape. The connecting member 140 is assembled axially movably to the metallic shaft 120 and the guide portion 132. The inner circumferential periphery of the connecting member 140 on the upper side, i.e., on the side of the lid module 110 has a step 142. The outer circumferential periphery of the connecting member 140 on the lower side, i.e., on the side of the pump module 130 has a large diameter portion 144. The large diameter portion 144 has the outer diameter, which is larger than the outer diameter of the other portion of the connecting member 140 excluding the large diameter portion 144. The upper end of the connecting member 140 on the side of the flange 112 has a hooking portion 146, which is in a substantially annular shape. The hooking portion 146 radially outwardly extends.

The step 142 of the connecting member 140 hooks to the pipe flange 122 of the metallic shaft 120, so that the connecting member 140 can be restricted form dropping off the metallic shaft 120. The large diameter portion 144 of the connecting member 140 on the side of the sub-tank 32 hooks to the radially small diameter portion 134 of the guide portion 132, so that the connecting member 140 can be restricted form dropping off the sub-tank 32. FIGS. 6, 7 depict conditions, in which the step 142 and the large diameter portion 144 of the connecting member 140 hook respectively to the pipe flange 122 of the metallic shaft 120 and the radially small diameter portion 134 of the guide portion 132, so that the connecting member 140 is restricted from dropping off the lid module 110 and the pump module 130. In these conditions depicted by FIGS. 6, 7, the lid module 110 and the pump module 130 are axially most distant from each other, while being connected with the connecting member 140. The pipe flange 122 of the metallic shaft 120, the radially small diameter portion 134 of the guide portion 132, the step 142 of the connecting member 140, and the large diameter portion 144 of the connecting member 140 construct a drop off restricting structure.

The outer diameter of the metallic shaft 120 excluding the pipe flange 122 is much less than the smallest inner diameter of the connecting member 140. Therefore, the connecting member 140 can be assembled to the metallic shaft 120 by inserting the metallic shaft 120 into the connecting member 140 from the lower side in FIG. 7, before the metallic shaft 120 is press-inserted into the connecting portion 114 of the flange 112. The large diameter portion 144 of the connecting member 140 can be assembled to the guide portion 132 by elastically deforming either the radially small diameter portion 134 of the guide portion 132 of the sub-tank 32 or the large diameter portion 144 of the connecting member 140.

Next, an assembling process of the fuel feed apparatus 100 to the fuel tank 2 is described.

In an initial step, as shown by FIGS. 6, 7, the step 142 on the upper side of the connecting member 140 hooks to the pipe flange 122 of the metallic shaft 120, and the large diameter portion 144 of the connecting member 140 hooks to the radially small diameter portion. 134 of the guide portion 132, so that the connecting member 140 is restricted from dropping off the metallic shaft 120 and the sub-tank 32. In these conditions depicted by FIGS. 6, 7, the lid module 110 and the pump module 130 are axially most distant from each other. Furthermore, FIGS. 6, 7 also depict conditions, in which the pump module 130 is inserted into the fuel tank 2 through the opening 3*a* of the fuel tank 2, so that the bottom of the sub-tank 32 makes contact with the inner bottom surface 4*a* of the fuel tank 2. The pump module 130 is inserted into the fuel tank 2 through the opening 3*a*, and subsequently, the canister 24 is inserted into the fuel tank 2 through the opening 3*a*. Therefore, the pump module 130 and the canister 24 are located in an offset manner laterally with respect to each other. That is, the pump module 130 and the canister 24 are laterally displaced from each other. In the conditions depicted by FIGS. 6, 7, the hooking portion 146 of the connecting member 140 does not hook to the upper end of the guide portion 132. Therefore, the sub-tank 32 is not applied with force toward the bottom wall 4 of the fuel tank 2.

In an intermediate step, the lid module 110 is inserted into the fuel tank 2 from the conditions depicted by FIGS. 6, 7, so that the connecting member 140 moves toward the inner bottom surface 4*a* of the fuel tank 2 together with the lid module 110, while the connecting member 140 is guided by the guide portion 132 of the sub-tank 32. Thus, as referred to FIG. 8, the hooking portion 146 of the connecting member 140 hooks to the upper end of the guide portion 132.

Figure 8:
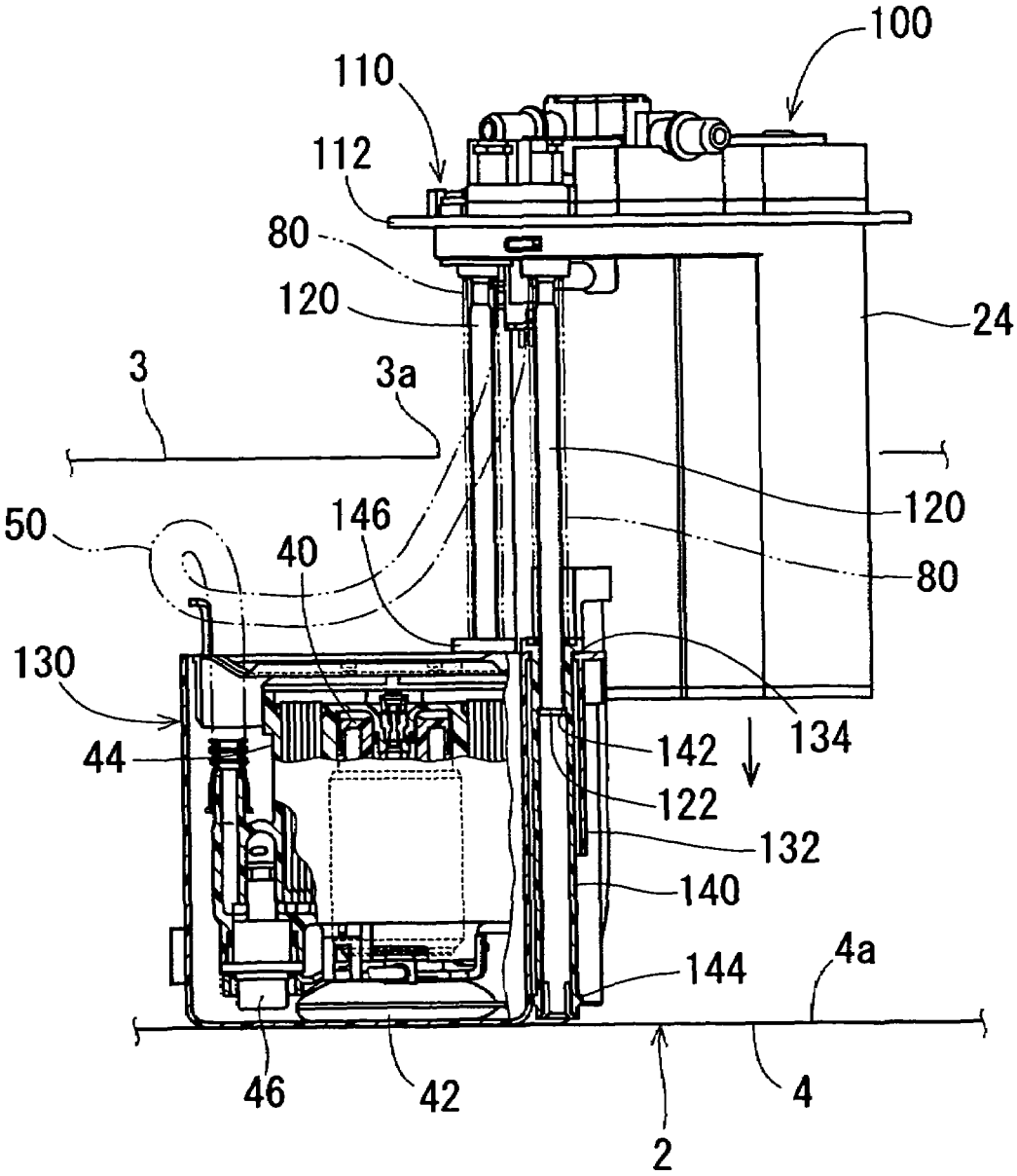
FIG. 8 is a longitudinal partially sectional view showing the fuel feed apparatus, which is partially inserted into the fuel tank, according to the second embodiment.

The lid module 110 is further pressed toward the inner bottom surface 4*a* of the fuel tank 2 from the condition depicted by FIG. 8 against bias force of the spring 80. In this condition, the lid module 110 moves toward the inner bottom surface 4*a* of the fuel tank 2, as the metallic shaft 120 is guided by the connecting member 140, while the position of the connecting member 140 is maintained. Thus, in the condition depicted by FIG. 8, the bias force of the spring 80 is applied to the sub-tank 32 via the hooking portion 146 of the connecting member 140, by pressing the lid module 110.

Figure 9:
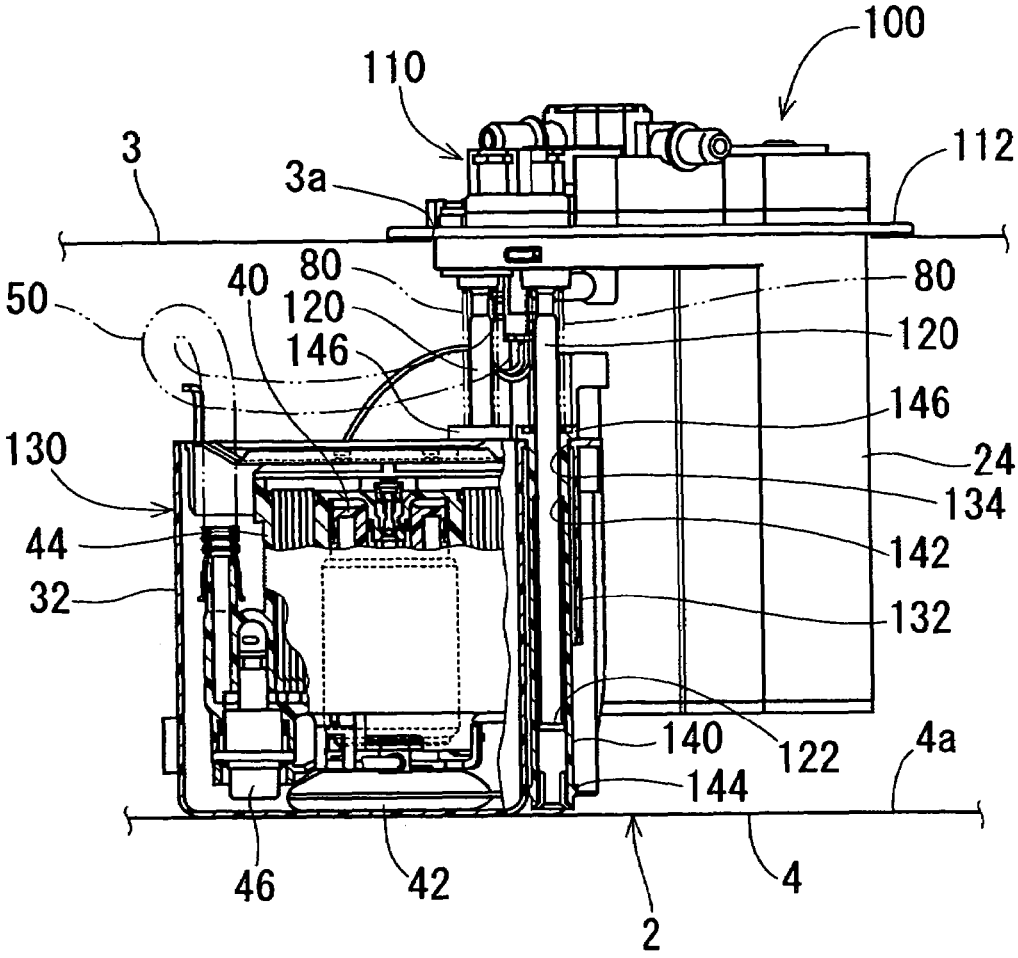
FIG. 9 is a longitudinal partially sectional view showing the fuel feed apparatus, which is assembled to the fuel tank, according to the second embodiment.

In a final step, the lid module 110 is further pressed toward the inner bottom surface 4*a* of the fuel tank 2 from the condition depicted by FIG. 8, so that the canister 24 is entirely inserted into the fuel tank 2, as shown by FIG. 9. In this condition, the flange 112 covers the opening 3*a* of the fuel tank 2, so that the assembling process of the fuel feed apparatus 100 to the fuel tank 2 is completed.

In this embodiment, the connecting member 140 is not a single member, dissimilarly to the connecting member 60 in the first embodiment. However, the two connecting members 140 are respectively assembled to the metallic pipes 230 of the lid module 110 and the guide portions 132 of the pump module 130 in the two locations, which are circumferentially distant from each other. Thus, the two connecting members 140 respectively connect the lid module 110 with the pump module 130. In this structure, the pump module 130 is also restricted from rotating with respect to the lid module 110. Thus, the pump module 130 can be restricted from rotating with respect to the lid module 110 when the fuel feed apparatus 100 is assembled to the fuel tank 2. Therefore, the assembling work of the fuel feed apparatus 100 to the fuel tank 2 can be facilitated.

In the above embodiments, the pump module is arranged in the remaining space, which is adjacent to the lateral periphery of the canister 24, in the offset manner. Therefore, the height of the fuel feed apparatus can be reduced, compared with a structure, in which the canister 24 and the sub-tank 32 are vertically located. Therefore, the fuel feed apparatus can be applied to a fuel tank, which is low in height.

Furthermore, the connecting member is assembled to the outer lateral periphery of the sub-tank 32 of the pump module, so that interference can be restricted between components in the sub-tank 32 and the connecting member. Furthermore, the connecting member does not occupy the inner space of the sub-tank 23, so that the inner volume of the sub-tank 32 can be maintained. Thus, the amount of fuel received in the sub-tank 32 can be maintained.

(Modification)

The drop off restricting structure may be provided between the connecting member and either one of the lid module or the pump module. The drop off restricting structure may be omitted.

The spring 80 may be omitted. The lid module may be connected with the pump module via the connecting member without using the spring.

The sub-tank 32 may be omitted. In this case, the connecting member may be connected with a pump case, which supports the fuel pump 40, for example.

The guide portion may be provided to the inside of the sub-tank 32, instead of being provided to the outside of the sub-tank 32, so that the connecting member may be assembled to the guide portion in the sub-tank 32. In this structure, when the lid module is pressed to the fuel tank 2, and the lid module is moved toward the pump module, the connecting member can be restricted from being pressed onto the inner bottom surface of the sub-tank 32, i.e., a member on the bottom side of the fuel tank 2. In addition, in this structure, the connecting member is located in the vicinity of the center of the sub-tank 32, so that the lid module can be stably assembled to the fuel tank 2.

The sub-tank 32 may have a tilt restricting portion.

In the above second embodiment, the number of the metallic shaft 120 may be one. Alternatively, the number of the metallic shaft 120 may be at least three.

In the above first embodiment, the number of the connecting member 60 may be at least two.

The above structures of the embodiments can be combined as appropriate.

Various modifications and alternations may be diversely made to the above embodiments without departing from the spirit of the present invention.

What is claimed is:

1. A fuel feed apparatus that pumps fuel in a fuel tank having an opening, the fuel feed apparatus comprising:

a lid module that includes a canister accommodated in the fuel tank, the canister defining a space in the fuel tank, the space being in the vicinity of a lateral periphery of the canister, the canister detachably absorbing fuel vapor in the fuel tank, the lid module covering the opening of the fuel tank;

a pump module that is located in the space for pumping fuel in the fuel tank; and a connecting member that connects the lid module with the pump module, the connecting member axially slidable with respect to the lid module and the pump module along the lateral periphery of the canister and a lateral periphery of the pump module, wherein when the lid module is connected to the fuel tank by moving the lid module toward the pump module along the connecting member, the connecting member hooks to the pump module, so that the connecting member is restricted from moving in a direction, in which the lid module moves toward the pump module.

2. The fuel feed apparatus according to claim 1, wherein the connecting member is located in an outside of the pump module.

3. The fuel feed apparatus according to claim 2, wherein the connecting member has an end on a side of an inner bottom surface of the fuel tank, the end of the connecting member includes a tilt restricting member on a substantially opposite side of the pump module, the tilt restricting member is adapted to restrict the connecting member from being inclined to a substantially opposite side of the pump module.

4. The fuel feed apparatus according to claim 1, further comprising:

a bias member that is located between the lid module and the connecting member, wherein the lid module is connected to the fuel tank by moving the lid module toward the pump module against bias force of the bias member from a condition, in which the connecting member hooks to the pump module by moving the lid module toward the pump module along the connecting member.

5. The fuel feed apparatus according to claim 1, wherein the connecting member is in a substantially plate shape.

6. The fuel feed apparatus according to claim 1, further comprising:

a drop off restricting structure that restricts the connecting member from dropping off at least one of the lid module and the pump module when the lid module moves axially away from the pump module along the connecting member.

7. The fuel feed apparatus according to claim 1, wherein the pump module includes a sub-tank and a fuel pump, the sub-tank accommodates the fuel pump, the connecting member connects the lid module with the sub-tank, and the connecting member hooks to the sub-tank, so that the connecting member is restricted from moving in a direction, in which the lid module moves toward the pump module, in a condition, in which the lid module is connected to the fuel tank.

8. The fuel feed apparatus according to claim 1, wherein the canister has an axial section, which is in a substantially semicircular section including a substantially arc-shaped section and a chord, the substantially arc-shaped section has two ends connecting with ends of the chord, and the space is located adjacent to the chord of the substantially semicircular axial section of the canister.

9. The fuel feed apparatus according to claim 1, wherein the pump module and the canister are located in an offset manner laterally with respect to each other.

* * * * *